United States Patent [19]

Hall

[11] Patent Number: 4,986,578

[45] Date of Patent: Jan. 22, 1991

[54] DOOR LATCHING ARRANGEMENT FOR AN ENCLOSURE

[75] Inventor: Walter J. Hall, Evanston, Ill.

[73] Assignee: S&C Electric Company, Chicago, Ill.

[21] Appl. No.: 262,854

[22] Filed: Oct. 24, 1988

[51] Int. Cl.[5] ..... E05B 67/00

[52] U.S. Cl. ..... 292/104; 292/334; 292/DIG. 68

[58] Field of Search ..... 292/104, 148, 205, 281, 292/334, DIG. 68

[56] References Cited

U.S. PATENT DOCUMENTS

| | | | |
|---|---|---|---|
| 1,729,038 | 9/1929 | French | 292/DIG. 68 |
| 1,766,193 | 6/1930 | Schmitz et al. | 292/DIG. 68 |
| 1,932,468 | 10/1933 | Knell | 292/DIG. 68 |
| 1,970,267 | 9/1934 | Bales | 292/334 |
| 2,033,806 | 3/1936 | Baker et al. | 292/DIG. 68 |
| 2,049,939 | 8/1936 | Bales | 292/334 |
| 2,163,307 | 6/1939 | Hart | 292/334 |
| 2,518,141 | 8/1950 | Hiler | 292/DIG. 68 X |
| 2,732,240 | 1/1956 | Hutzelman | 292/DIG. 68 |
| 3,055,996 | 9/1962 | Beebe et al. | 200/50 |
| 3,572,062 | 3/1971 | Beebe | 70/1.5 |
| 3,722,236 | 3/1973 | Zelenko | 292/DIG. 68 |
| 3,744,831 | 7/1973 | Joseph et al. | 292/DIG. 68 |
| 4,489,966 | 12/1984 | Beebe et al. | 292/334 |
| 4,806,710 | 2/1989 | Kalvaitis et al. | 200/50 A |

OTHER PUBLICATIONS

Photo Sheet 671-710 dated Jul. 11, 1983, S&C Electric Company.

Descriptive Bulletin 671-31 dated Apr. 30, 1984, S&C Electric Company.

Drawing A (8-6-87) S&C Electric Company.

Drawing B (1-15-86) S&C Electric Company.

*Primary Examiner*—Gary L. Smith

*Assistant Examiner*—Michael J. Milano

*Attorney, Agent, or Firm*—James V. Lapacek

[57] ABSTRACT

A door latching arrangement is provided for an enclosure that stores energy at each position in a range of opening positions such that if the door is manipulated to permit opening, sufficient energy is available to permit the automatic latching of the door upon closing. The door latching arrangement includes a movable latch arm which in a specific arrangement is carried by the door. The latch arm is biased to engage a projection or hasp of the enclosure when the door is closed. A latch retaining member carried by the door is arranged to interact with the latch arm to prevent the engagement of the latch arm by the hasp. Movement of the latch arm to disengaged the hasp, coupled with the opening of the door to separate the hasp and the latch retaining member, results in the latch retaining member moving to a position to interact with and retain the latch arm. When the door is closed, the hasp conditions the latch retaining member out of interaction with the latch arm, permitting the latch arm to automatically re-engage the hasp. In a specific arrangement, the latch retaining member and the latch arm include a pawl and ratchet combination that is operative upon movement of the latch arm out of engagement with the hasp and as the door is opened to separate the hasp and the latch retaining member.

4 Claims, 4 Drawing Sheets

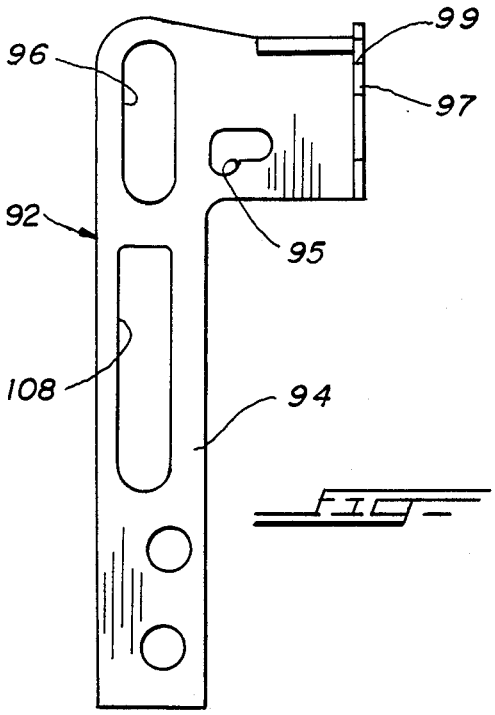
FIG. 5
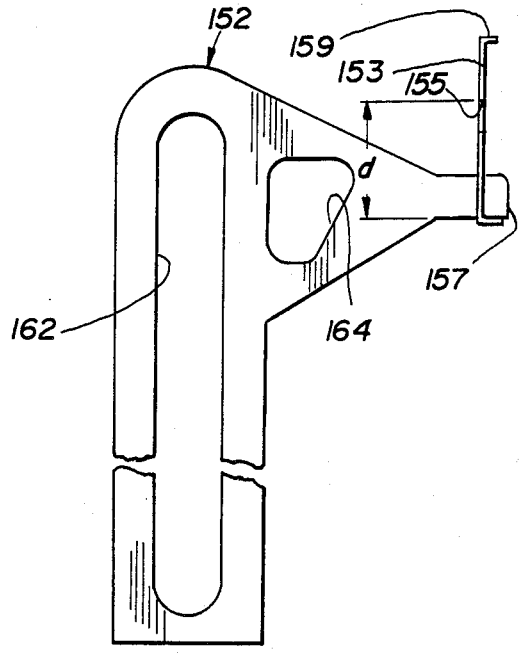
FIG. 6
FIG. 7
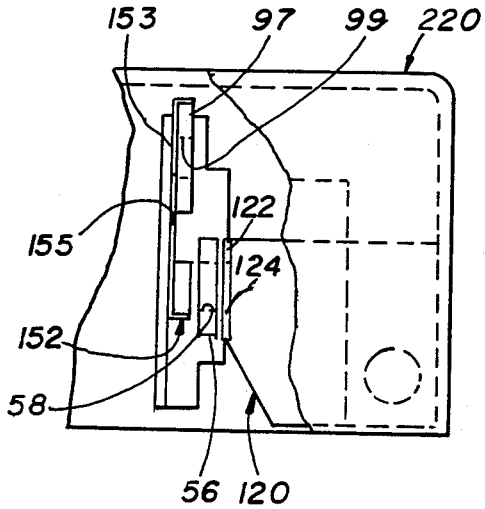
FIG. 8
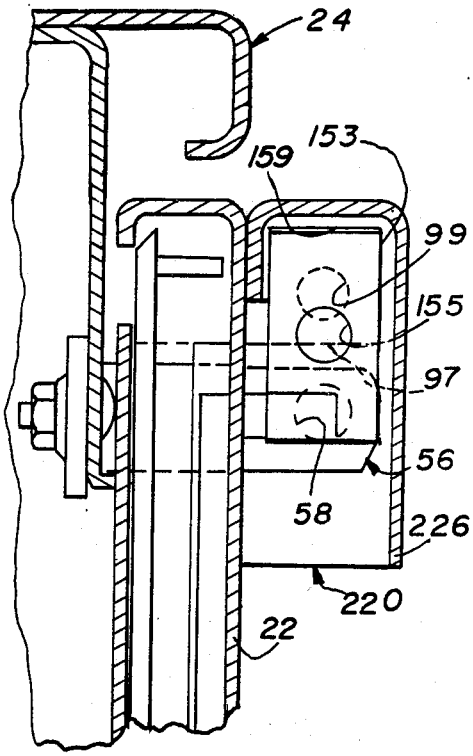

DOOR LATCHING ARRANGEMENT FOR AN ENCLOSURE

BACKGROUND OF THE INVENTION

1. Field of the Invention

The present invention relates generally to a door latching arrangement for an enclosure and more particularly to a latching arrangement which upon being manipulated sufficiently to allow opening of a door, ensures that the door may be closed and automatically relatched upon closure of the door.

2. Description of the Related Art

Various door latching arrangements for enclosures and the like are well known in the art. For example, see commonly assigned U.S. Pat. Nos. 3,055,996, 3,572,062, and 4,489,966, as well as commonly assigned U.S. application Ser. No. 095,280 now U.S. Pat. No. 4,806,710. For the enhancement of access control, it is desirable to coordinate door latching, the locking of the door via a padlock, and the unlatching of the door with a restricted tool. For example, the door latching arrangement of the aforementioned U.S. Pat. No. 4,489,966 includes many desirable features. In that arrangement, rotation of a tool-engageable member by a suitable tool unlatches the door for opening. Additionally. facilities are provided such that upon closure of the door, automatic latching of the door occurs. The arrangement also provides facilities to prevent the reception of a lock shackle unless the door latching arrangement is latched.

While the aforementioned door latching arrangements may be generally suitable for their intended use, it is always desirable to advance the state of the art and provide additional desirable features to enhance ease of use and to ensure proper unlatching and latching sequencing and operation.

SUMMARY OF THE INVENTION

Accordingly, it is a principal object of the present invention to provide a door latching arrangement which enhances automatic latching upon closure of the door after the door latching arrangement has been manipulated so as to allow opening of the door.

It is another object of the present invention to provide a desirable arrangement to prevent the insertion of a padlock shackle unless the door latching arrangement is latched.

It is a further object of the present invention to provide a door latching arrangement that stores energy at each position in a range of opening positions, such that if the door is manipulated to permit opening, sufficient energy is available to permit the automatic latching of the door upon closing.

It is yet another object of the present invention to provide an arrangement to prevent ingress to the vicinity of the door latching arrangement where the padlock shackle is received.

These and other objects of the present invention are efficiently achieved by the provision of a door latching arrangement for an enclosure which automatically latches upon closing of the door once the latching arrangement has been manipulated to allow opening of the door. The door latching arrangement includes a movable latch arm which in a specific arrangement is carried by the door. The latch arm is biased to engage a projection or hasp of the enclosure when the door is closed. A latch retaining member carried by the door is arranged to interact with the latch arm to prevent the engagement of the latch arm by the hasp. Movement of the latch arm to disengage the hasp, coupled with the opening of the door to separate the hasp and the latch retaining member, results in the latch retaining member moving to a position to interact with and retain the latch arm. When the door is closed, the hasp conditions the latch retaining member out of interaction with the latch arm, permitting the latch arm to automatically re-engage the hasp. In a specific arrangement, the latch retaining member and the latch arm include a pawl and ratchet combination that is operative upon movement of the latch arm out of engagement with the hasp and as the door is opened to separate the hasp and the latch retaining member. Thus, if the opening motion of the latch arm is ceased at an intermediate position, the latch arm is retained along its path of movement. In this manner, the latch arm can be held in intermediate positions of movement between the closed position and the fully opened positiondue to the interaction of the latch retaining member and the latch arm. Accordingly, movement of the latch arm to a sufficient degree to allow opening of the door provides that, upon closing of the door, the door will be latched. In a specific arrangement, the latch retaining member includes a pawl projection and the latch arm includes ratchet teeth.

BRIEF DESCRIPTION OF THE DRAWING

The invention, both as to its organization and method of operation, together with further objects and advantages thereof, will best be understood by reference to the specification taken in conjunction with the accompanying drawing in which:

FIG. 5 is an elevational view of a latch slide arm forming a portion of the latching arrangement of FIGS. 1–4., FIG. 6 is an elevational view of a blocking slide arm forming a portion of the latching arrangement of FIGS. 1–4;

FIG. 7 is an enlarged, partial front elevational view of a portion of the latch arrangement of the present invention, with parts cut away, depicting the relative position of the latch slide arm, the blocking slide arm, and a locking staple to illustrate a particular stage of operation; and FIG. 8 is a sectional elevation taken along line 8—8 in FIG. 7 and further illustrating the relative positions of the components of the latching arrangement at a particular stage of operation.

DETAILED DESCRIPTION

Figure 1:
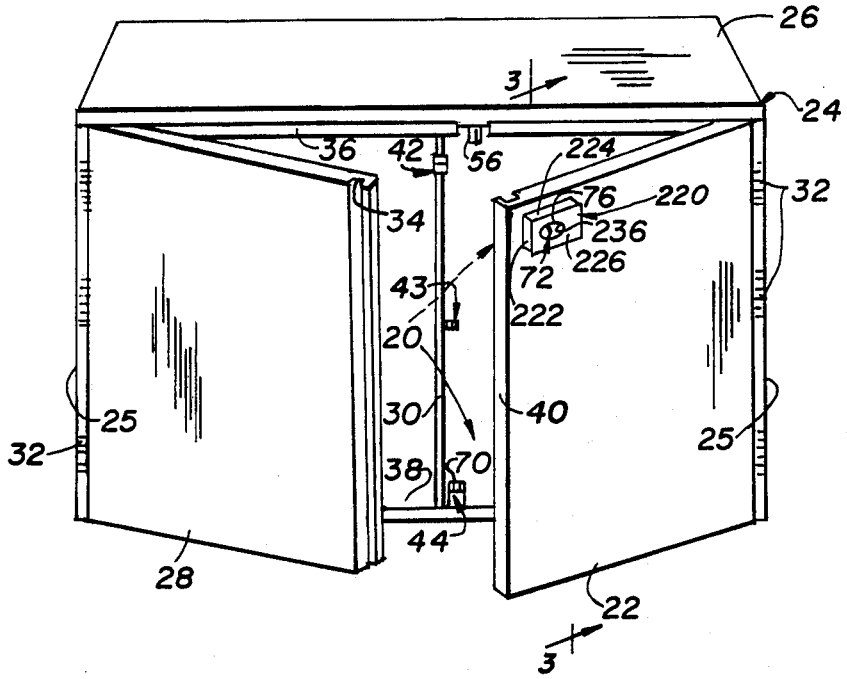
FIG. 1 is a perspective view of a walled enclosure having one or more doors, at least one being provided with the latching arrangement of the present invention.

Referring now to FIG. 1, a latch arrangement 20 according to the present invention is shown in use on a door 22 of an enclosure 24. In a specific environment, the enclosure 24 houses high-voltage electrical gear, such as switches, fuses, buses, etc. (not shown). The enclosure 24 includes a plurality of side walls 25 covered by a roof 26. Access to the interior of the enclosure 24 is gained by opening the door 22. As illustrated in FIG. 1, an additional door 28 may be provided, in which case the door 22 may be arranged to suitably overlie and interfit with the door 28 so as to maintain the door 28 in the closed position when the door 22 is closed. The doors 22,28 are rotatably mounted with respect to the enclosure 24 by hinges 32. A dividing wall 30 physically separates the interior of the enclosure 24 into compartments. In a preferred arrangement, the latch arrangement 20 of the present invention holds the door 22 closed at two or more points. As indicated in FIG. 1, latch engageable members or hasps 42, 43, and 44 are provided that are carried by the enclosure 24.

Figure 2:
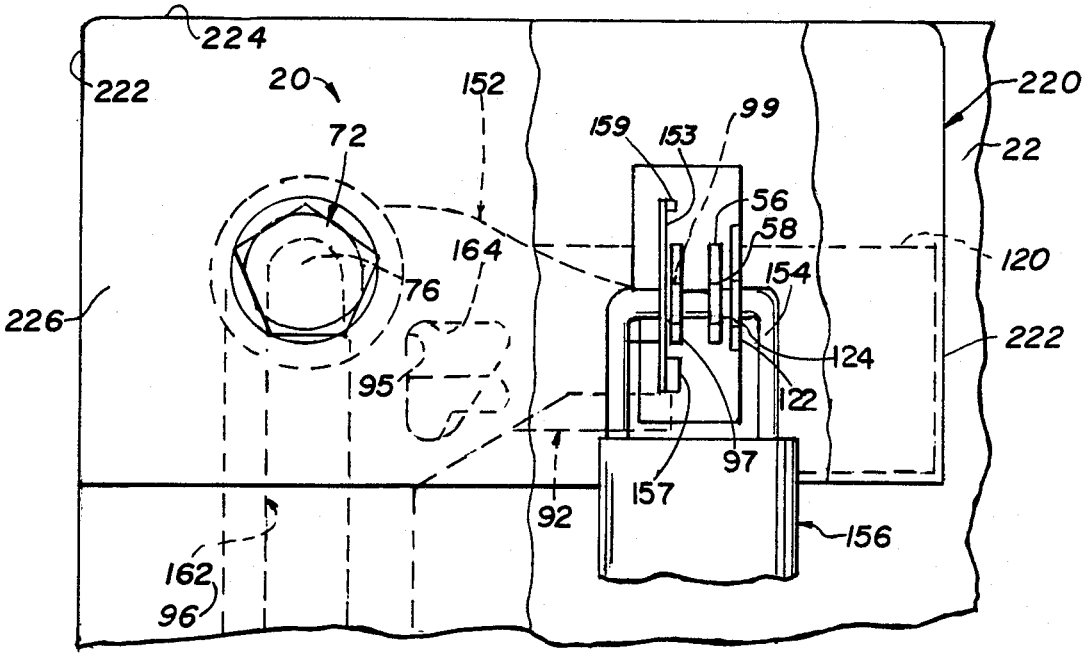
FIG. 2 is an enlarged, partial front elevation of a portion of the latching arrangement of the present invention.
Figure 3:
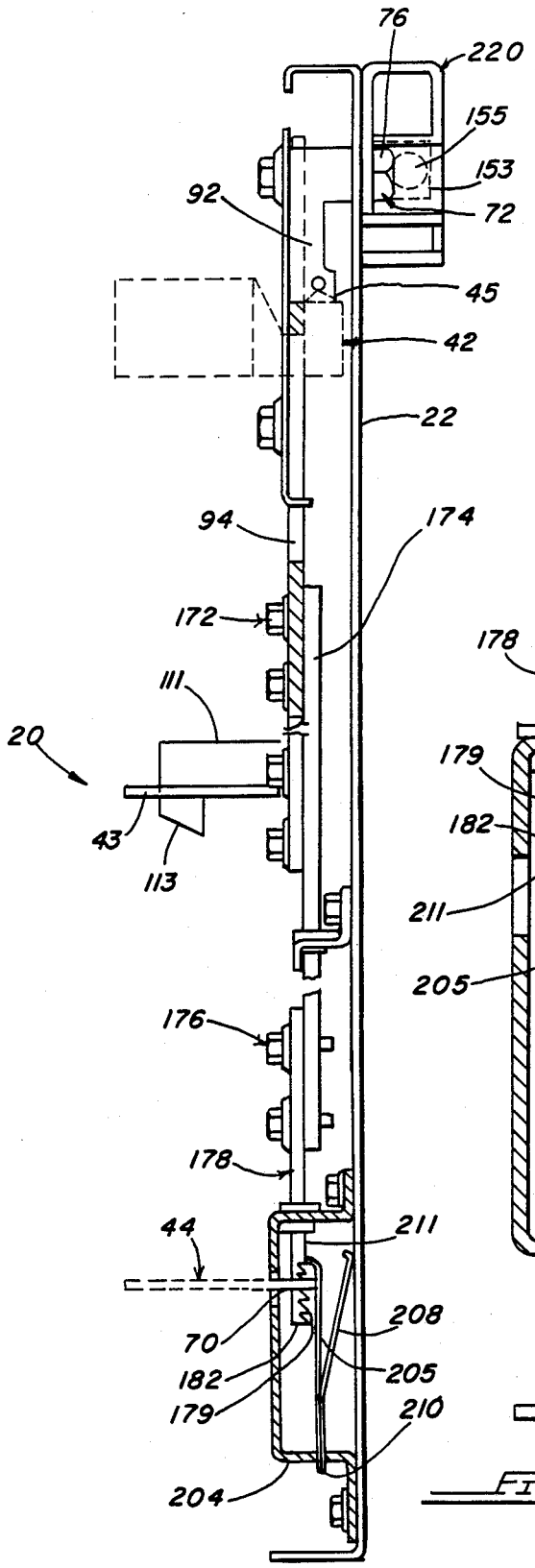
FIG. 3 is a partially sectioned, side elevation of one door of the enclosure of FIG. 1 depicting certain features of the latching arrangement of the present invention and taken along line 3—3 in FIG. 1.
Figure 4:
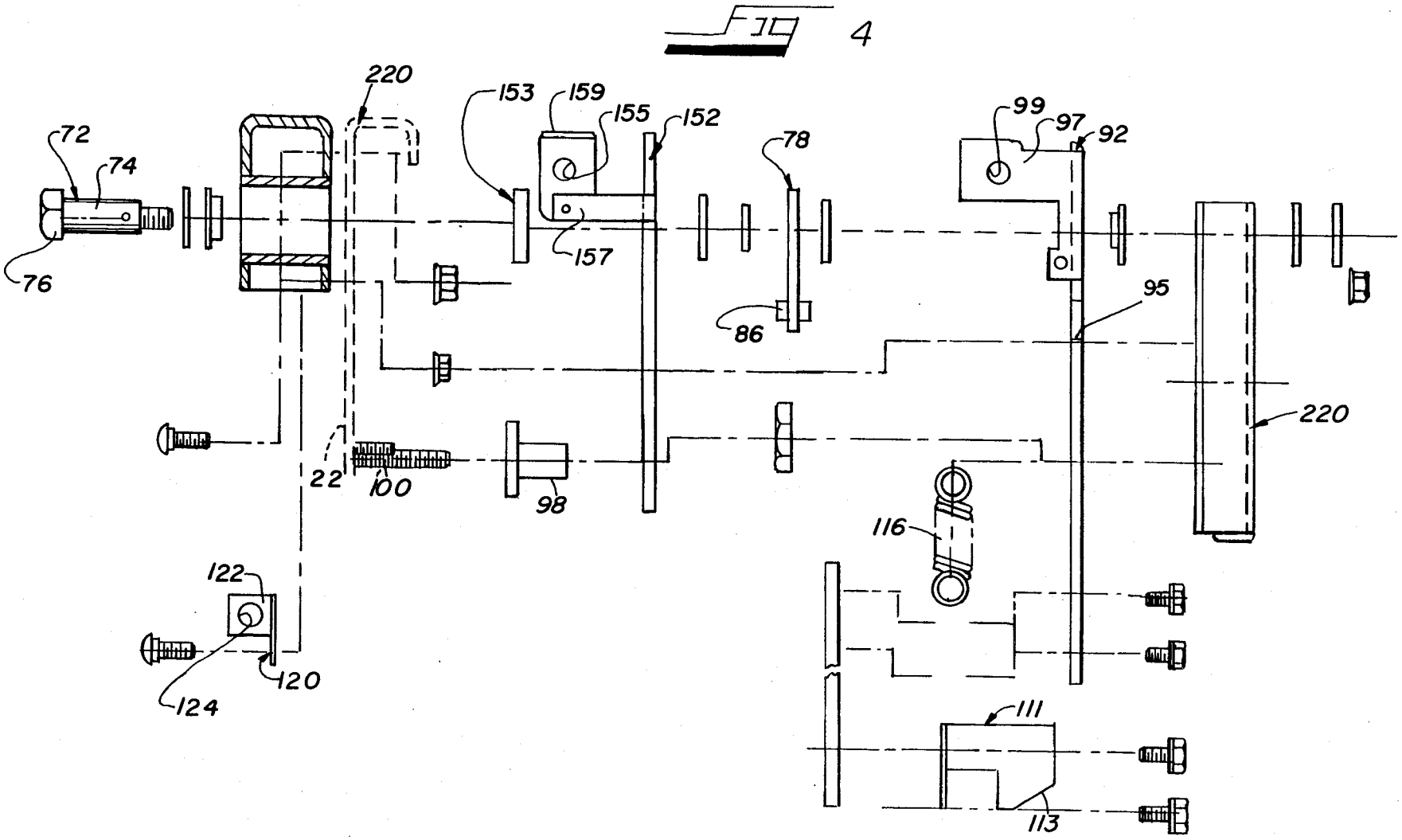
FIG. 4 is an exploded view of a portion of the latching arrangement of FIGS. 1–3.

Turning now also to FIGS. 2, 3, and 4, the latch arrangement 20 includes a drive member 72 which preferably takes the form of a drive shaft 74 having a polygonal head 76. Referring additionally to FIG. 5, the latch arrangement 20 includes a latch slide arm 92 including an elongated portion 94. The latch slide 92 also includes a slot 108 (FIG. 5) which cooperates with the upper hasp 42. The latch slide arm 92 is arranged to be driven by the provision of a slot 95 and a vertical elongated slot 96. To this end, a drive lever 78 is fixedly carried by the drive shaft 74. The drive lever 78 includes a protruding drive pin 86 which projects through the slot 95 of the latch slide arm 92. Rotation of the drive shaft 74 via the drive lever 78 and the drive pin 86 lifts the latch slide arm 92 with the drive pin 86 acting against the walls of the slot 95. The latch slide arm 92 is biased downwardly by a spring 116. A bushing 98 is carried about a stud 100 mounted to the door 22. The bushing 98 is positioned through the slot 108. Reference may be made to U.S. Pat. No. 4,489,966 for a more complete disclosure of the structure and function of the latch arrangement of this general type, and that patent is hereby incorporated by reference for all purposes.

Referring additionally to FIG. 3, the latch slide arm 92 at the elongated portion 94 is attached to a connecting link 174 via fasteners 172 to provide an overall elongated latch arm. A lower latch slide arm 178 is connected to the connecting link 174 via fasteners 176. A lower end 182 of the lower slide latch arm 178 cooperates with the lower hasp 44. The connecting link 174 carries a middle latch member 111 which cooperates with the middle hasp 43 of FIG. 1.

In accordance with important aspects of the present invention, the latch arrangement 20 includes a latch retaining member 205 having a lower hook-shaped portion 210 inserted through an aperture 204 in the lower wall of the door 22. The latch retaining member 205 also includes an upper hook 211 that is fabricated to function as a pawl. To that end, the lower end 182 of the lower slide latch 178 includes a plurality of ratchet teeth at 179 with which the pawl 211 cooperates. A latch spring member 208 is inserted through the aperture 204 which biases the latch retaining member 205 to the left in FIG. 3. The latch retaining member 205 may also be referred to as a holding member, a supporting member, or a retaining member.

The latch arrangement 20 is illustrated in FIG. 3 in the latched position with the lower end 182 of the lower latch arm 178 passing through the aperture 70 of the lower hasp 44. In the latched position, the middle latch member 111 engages the middle hasp 43 and the upper hasp 42 engages the latch slide arm 92. A locking staple or tab 56 (FIGS. 1 and 2) extends from the enclosure 24. The locking staple 56 includes a hole 58 for the reception of a lock shackle 154 (FIG. 2) of a lock 156 (FIG. 2). When the door 22 is closed, the locking staple 56 is generally parallel to and adjacent a tab or planar portion 97 of the latch slide arm 92. The planar portion 97 of the latch slide arm includes an alignment hole 99. The holes 58 and 99 are aligned such that when the door 22 is closed and the latch slide arm 92 is in the latched position, the shackle 154 of the lock 156 can be positioned therethrough to lock the door 22 and prevent movement of the latch slide arm 92.

Figure 3A:
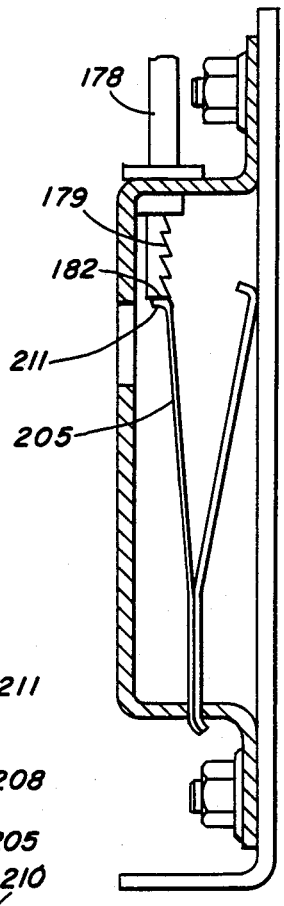
FIGS. 3*a* and 3*b* are partial views of FIG. 3 illustrating portions of the latching arrangement in different operating positions.

When the drive shaft 74 via drive member 72 is rotated so as to lift the overall latch arm including the latch slide arm 92, the connecting link 174, and the lower slide latch arm 178, the respective portions (walls of slot) 108, 111, and 182 are free of the respective hasps (42, 43, and 44). Referring additionally to FIG. 3*a*, the latch slide portions 92, 111, and 178 have been raised sufficiently via rotation of the drive member 72 to the fully raised position such that the hook 211 of the latch retaining member 205 (under the bias of the latch spring member 208) moves under the lower end 182 of the lower slide latch 178 when the door 22 is opened to separate the lower hasp 44 and the latch retaining member 205, thereby holding the overall latch arm in the fully raised position. At this point, the door 22 may be fully opened and any desired inspection or maintenance or the like can be performed by operating personnel in accordance with appropriate operating procedures.

When it is desired to close the door 22 and re-latch the door, the door 22 is closed such that the lower hasp 44 contacts the latch retaining member 205 and displaces the latch retaining member 205 so as to be free of the lower end 182 of the lower latch slide arm 178, thereby releasing the overall latch arm with the latch portions (walls of slot) 108, 111, and 182 engaging the hasps 42, 43 and 44 for positive latching of the door 22 so as to assume the configuration of FIG. 3.

Figure 3B:
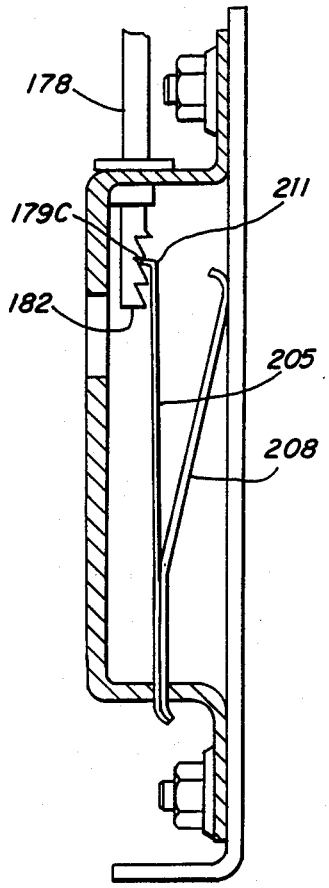

With additional reference to FIG. 3*b*, the lower latch slide arm 178 is depicted in an intermediate, open position wherein the drive member 78 has been rotated so as to lift the end 182 of the latch slide arm 178 free of the hasp 44; the other latch portions being moved free of the hasps 42,43 and the door 22 being opened so as to separate the hasp 44 from the latch retaining member 205. It can be seen that the lower latch slide arm 178 and the connected overall latch arm are held in the intermediate position of FIG. 3*b* due to the interaction of the pawl 211 engaging the ratchet tooth at 179C. With this arrangement, if the drive member 72 is not fully rotated to the fully open position of FIG. 3, the overall latch arm will not drop down after the door is opened. Thus, as long as the drive member 72 is rotated to a position sufficient to allow opening of the door (i.e., the end 182 of the latch slide arm 178 being free of the hasp 44), it is ensured that the door can be automatically and positively latched upon closure thereof. Additionally, the middle latch member 111 and the upper hasp 42 are provided with inclined ramp surfaces at 113 and 45, respectively, so as to facilitate cooperation with the hasp 43 and the walls of the slot 108 when the overall latch arm is raised sufficiently to open the door 22 but is not lifted to the fully raised position.

Referring again to FIGS. 2, 3, and 4 and referring additionally to FIG. 6, the latch arrangement 20 also includes a blocking slide arm 152 which is movably carried about the drive shaft 74 via an elongated slot 162. The blocking slide arm 152 also includes a second slot 164 through which the drive pin 86 extends; the slot 164 being dimensioned for purposes as will be more fully explained hereinafter. The bushing 98 also extends through the slot 162.

In accordance with the features of the present invention, the blocking slide arm 152 functions to prevent the insertion of the shackle 154 of the lock 156 (or other article) through either the alignment hole 99 of the latch slide arm 92 or the hole 58 of the locking staple 56 when the latch arrangement 20 is in any position other than the closed, fully latched position. To this end, in addition to the alignment and blocking provided by the tab or planar portion 97 of the latch slide arm 92, the blocking slide arm 152 includes a tab or planar portion 153 extending generally at right angles to the plane of the blocking slide arm 152. The planar portion 153 includes an alignment hole 155 for the shackle 154 of the lock 156. As shown in FIG. 6, when the overall latch arm is in the closed, latched position, the alignment hole 155 is aligned with the alignment holes 99 and 58 to permit the passage of the lock shackle 154. Preferably, the blocking slide arm 152 also includes a projection 157 which extends at right angles to the plane of the blocking slide arm 152 and which may conveniently be arranged to support the planar portion 153.

Referring additionally to FIGS. 7 and 8, when the overall latch arm of the latch arrangement 20 is in the fully raised position, the projection 157 is aligned with the hole 99 to block the entry of a lock shackle or similar article. To accomplish the appropriate blocking over the full range of movement of the overall latch arm, a ledge 159 is formed on the planar portion 153 and disposed so as to be contacted by the planar portion 97 of the latch slide arm 92 during movement thereof. The ledge 159 along with the dimensions of the slot 164 provides for lost motion between the blocking slide arm 152 and the latch slide arm 92. Specifically, when the latch slide arm 92 is driven upward to open the door 22, the blocking slide arm 152 does not move upward until the top of the portion 97 contacts the ledge 159, whereafter the blocking slide arm 152 is lifted upward so as to correspond with or "follow" the movement of the latch slide arm 92 to thereby provide appropriate blocking. The configuration of FIGS. 7 and 8 illustrates the relative positions of the locking staple 56, the planar portion 153 of the blocking slide arm 152, and the planar portion 97 of the latch slide arm 92 with the overall latch arm in the fully raised position. The slot 164 of the blocking slide arm 152 is dimensioned such that the drive pin 86 does not engage or move the blocking slide arm 152 until after the ledge 159 is contacted by the portion 97 of the latch slide arm 92.

In this manner, the appropriate blocking is provided while the dimensions of the portion 153 of the blocking slide arm 152 can be minimized so as to not require a lock shackle of unduly great length to clear the bottom of the portion 153 of the blocking slide arm 152 and permit the closing of the lock 156, as shown in FIG. 2. As can be seen from FIG. 2, during the range of movement of the latch slide arm 92 from the closed, latched position of FIG. 2 until the top of the portion 97 contacts the ledge 159, the blocking slide arm 152 in combination with the portion 97 of the latch slide arm 92 prevents the insertion of a lock shackle at any position throughout the range.

In accordance with additional aspects of the present invention, a blocking element 120 (FIGS. 2, 4, 7, and 8) is provided to discourage the entry of objects in the vicinity of the locking staple 56 from a direction opposite to the insertion of the lock shackle; i.e., from the right-hand side in FIGS. 2 and 7. The blocking element 120 includes a planar portion 122 arranged generally parallel to the portions 97 and 153 and also the locking staple 56 when the door 22 is in the closed position. The portion 122 includes a hole 124 that is dimensioned and arranged for the passage of the lock shackle 154. The blocking element 120 is carried by the door 22, preferably by a walled member or pocket 220. Accordingly, objects larger than the shackle of a lock are prevented from entering the vicinity of the locking area.

Preferably, the walled member or pocket 220 (FIGS. 1 and 2) is mounted to the front surface of the door 22. The pocket 220 has two side walls 222 and a top wall 224, all joined to a front wall 226. The portion of the pocket 220 below and parallel to the top wall 224 is left open. The pocket 220 is of sufficient dimension to encompass and cover the planar portion 153 of the blocking slide member 152, the planar portion 97 of the latch slide member 92, the blocking element 120, and the locking staple 56 when the door 22 is in the fully closed position. The pocket 220 also preferably encompasses the portion of the drive shaft 74 between the polygonal head 76 and the door 22. As explained in more detail in the aforementioned U.S. Pat. No. 4,489,966, the enclosing of the pocket 220 on all sides, except for the bottom, protects the drive member 22, the planar portions 153 and 97, the blocking element 120, the locking staple 56, and a lock 156. Of course, the opening at the bottom of the pocket 220 permits the insertion of the shackle 154 through the holes 58, 99, 155, and 224. Preferably, the height of the front wall 226 of the pocket 220 is such that when the padlock 156 is in place, both the shackle 154 and the upper portion of the body of padlock 156 are covered by the front wall 226 of the pocket 220.

While there have been illustrated and described various embodiments of the present invention, it will be apparent that various changes and modifications will occur to those skilled in the art. For example, while the latching arrangement of the present invention has been described with the latch engageable members or hasps 42, 43, and 44 being carried by the enclosure 24 and the latch arm being carried by the door 22, it should also be realized that in other embodiments the hasps 42, 43, and 44 are carried by the door and the latch arm is carried by the enclosure. It is intended in the appended claims to cover all such changes and modifications as fall within the true spirit and scope of the present invention.

What is claimed and desired to be secured by Letters Patent of the United States is:

1. A door latching arrangement for latching the door of an enclosure comprising:

a latch member carried by the door and being movable over a range of movement including a latched position;

a first receiver member for said latch member carried by the enclosure and cooperating with said latch member for latching the door;

means for urging said latch member toward a latched position in engagement with said first receiver member and for selectively moving said latch member out of said latched position;

means for retaining said latch member in a retained position in a predetermined range of positions and out of said latched position whenever said latch member is moved out of said latched position to an extent to permit opening of the door, said retained position being dependent upon the extent of movement of said latch member;

means for releasing said latch member to be moved by said urging means to said latched position when the door is moved to a closed position;

a first tab member carried by and extending from the enclosure, said first tab member having a first alignment hole, said latch member comprising an elongated latch arm and a second tab member extending therefrom, said second tab member having a second alignment hole, said second tab member being arranged so as to be generally parallel to and adjacent said first tab member with said first and second alignment holes being aligned when the door is in the closed position and said latch member is in said latched position;

a movable blocking member;

a third tab member extending from said blocking member, said third tab member having a third alignment hole and being arranged so that said third tab member is adjacent to and generally parallel to said first and second tab members with said first, second, and third alignment holes being aligned when said door is in the closed position and said latch member is in said latched position; and means for moving said blocking member at a predetermined position of movement of said latch member, said moving means comprising said blocking member including engageable means for being engaged by said latch member at a predetermined position of movement of said latch member, said latch member engaging said engageable means before said second tab member has moved to a position that is non-blocking with respect to said first and third alignment holes.

2. The door latching arrangement of claim 1 wherein said engageable means comprises said third tab member being dimensioned and engaged by said latch member so as to provide predetermined blocking of said first and second alignment holes over a predetermined range of positions of said latch member.

3. A door latching arrangement for latching the door of an enclosure comprising:

a latch member carried by the door and being movable over a range of movement including a latched position;

a first receiver member for said latch member carried by the enclosure and cooperating with said latch member for latching the door;

means for urging said latch member toward a latched position in engagement with said first receiver member and for selectively moving said latch member out of said latched position;

means for retaining said latch member in a retained position in a predetermined range of positions and out of said latched position whenever said latch member is moved out of said latched position to an extent to permit opening of the door, said retained position being dependent upon the extent of movement of said latch member;

means for releasing said latch member to be moved by said urging means to said latched position when the door is moved to a closed position;

lock-shackle receiving means carried by the enclosure; and alignment and blocking means for permitting the insertion of objects smaller than a first predetermined size into said lock-shackle receiving means when said latch member is in said latched position and said door is closed and for blocking the insertion of objects larger than a second predetermined size when the door is in the closed position and said latch member is moved out of said latched position to the extent to permit opening of the door, said first predetermined size being larger than said second predetermined size, said alignment and blocking means comprising a first planar member extending from said latch member and including a first alignment hole, and a second planar member including a second alignment hole that is aligned with said first alignment hole when said latch member is in said latched position, said second planar member being movable with respect to said latch member, said alignment and blocking means further comprising means for moving said second planar member in a predetermined manner after said latch member has moved a first predetermined distance.

4. The door latching arrangement of claim 3 further comprising means carried by the door for defining an area of insertion that is aligned with said lock-shackle receiving means when the door is closed, said alignment and blocking means further comprising means for blocking the insertion of an object larger than said second predetermined size into said area of insertion whenever the door is opened.

* * * * *